United States Patent [19]

Ristvedt et al.

[11] 4,234,003

[45] * Nov. 18, 1980

[54] COIN HANDLING MACHINE

[76] Inventors: Victor G. Ristvedt, Rte. 2, Forestwood Dr.; Roy B. Johnson, Rte. 6, Belmar Cir., both of Manchester, Tenn. 37355

[ * ] Notice: The portion of the term of this patent subsequent to Jul. 4, 1995, has been disclaimed.

[21] Appl. No.: 921,063

[22] Filed: Jun. 30, 1978

Related U.S. Application Data

[63] Continuation of Ser. No. 735,060, Oct. 22, 1976, Pat. No. 4,098,280.

[51] Int. Cl.[3] ..... G07D 3/00

[52] U.S. Cl. ..... 133/3 A; 133/8 R

[58] Field of Search ..... 133/1 R, 3 R, 3 A, 8 R; 271/167-169; 198/392; 209/915, 917

[56] References Cited

U.S. PATENT DOCUMENTS

| | | | |
|---|---|---|---|
| 1,894,190 | 1/1933 | Myers | 133/3 R |
| 1,979,659 | 11/1934 | Zierick | 133/3 A |
| 2,906,276 | 9/1959 | Blanchette et al. | 133/3 R |
| 3,771,538 | 11/1973 | Reis | 133/8 R |
| 4,098,280 | 7/1978 | Ristvedt et al. | 133/3 A |

*Primary Examiner*—H. Grant Skaggs
*Attorney, Agent, or Firm*—C. A. Phillips

[57] ABSTRACT

A coin sorting machine in which coins are fed onto the center of a rotating disc having a flexible surface. An annular guide plate is positioned over the disc, being open in the center for receiving coins, and extending outward to the peripheral edge of the disc. The underside of the guide plate is formed with a peripheral stop extending around approximately half of the disc, and a series of discrete radiused guides extend over portions of the other half of the disc. The first of the series of guides would have an outer edge differing in radius from the peripheral stop by the diameter of the smallest coin to be sorted, and each succeeding guide would have a progressively smaller radiused outside edge defined by the difference between coins to be sorted by succeeding guides.

5 Claims, 10 Drawing Figures

COUNTER
COUNTER

COIN HANDLING MACHINE

This is a continuation of application Ser. No. 735,060 filed 10/22/76, and now U.S. Pat. No. 4,098,280.

BACKGROUND OF THE INVENTION

1. Field of the Invention

This invention relates to coin handling machines employing a rotating disc for sorting and verifying coins.

2. General Description of the Prior Art

The denominational sorting of coins is a substantial chore for handlers of coins, particularly banks and vending machine companies. In view of the tremendous volume of coins which are sorted, it is quite obvious that for a machine to adequately meet their needs, the machine must be capable of high-speed operation. Further, it must be tolerant to a variation of coin thicknesses and be relatively jam-proof. With respect to speed, sorting speeds of known devices are in the range of 1,500 to 2,500, and at this time, the applicants have been advised that much higher speeds, ideally in the range of 6,000 to 8,000, are much needed. Ideally, coin verifiers, devices for verifying the number of coins in a container, should operate at speeds substantially higher than possible with existing devices, which it is believed operate in a range up to about 10,000 coins per minute.

An object of the present invention is to provide a coin sorter of simpler construction than previously existed and to provide a coin verifier with much increased speed, speed in the range upward to 20,000 coins per minute.

SUMMARY OF THE INVENTION

In accordance with this invention, a guide plate is positioned over a rotating disc having a flexible, generally flat, surface, the spacing between the two being generally that of the thickest coin to be handled. A series of lands extend down to the surface of the disc, forming a series of guide means to control coin movement. A first guide means includes an annular-shaped land or guide having an inward facing shoulder extending part way around the disc and inboard of the periphery of the disc, it functioning to receive coins moved by centrifugal force from the center of the disc outward and to initially form the coins in a generally circular single file. A second guide means employs a peripheral limit and stabilizing guide, and this guide means extends around a part of the disc which does not circumferentially border the first guide means. The stabilizing effect is achieved by a guide being tapered downward with increasing radial dimension to thus form an interfacing edge, whereby coins are wedged between this guide and the flexible surface of the disc as they are rotated. A third guide means consists of a passageway between the first and second guide means, and this passageway is generally along a line normal to a radial line. In the case of a coin sorter, coin release guide means are included which have a series of coin release guides which commence at an operating end of the second guide means, each successive coin release guide having an outer release radius progressively smaller than the radius of the preceding guide by the difference in diameter of coins to be released by successive guides. Where they appear, leading edges of the guide means are tapered so that a coin striking a leading edge will not be stopped by the leading edge, but will be depressed into the flexible surface and captured, and the coin will be caused to rotate at a fixed radial distance until it is no longer depressed by that guide means, whereby a captured coin will either be released by a coin release or rotated back into the center region of the disc, enabling it to be repositioned on an inner facing shoulder of the first guide means, and thereafter positioned in a single file.

DETAILED DESCRIPTION OF THE DRAWINGS

Figures 1, 2, 3, 4:
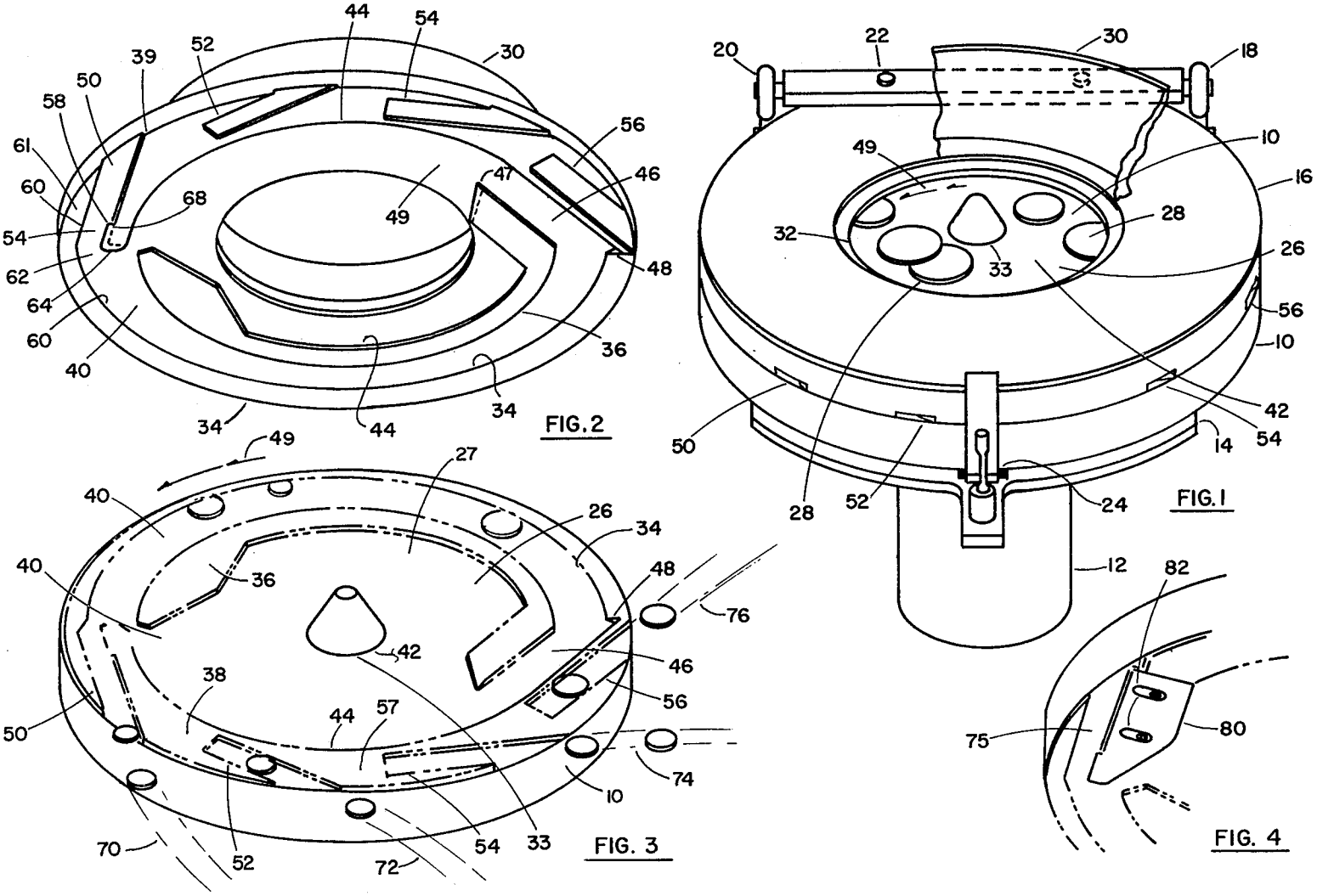
FIG. 1 is a pictorial view of an embodiment of this invention.
FIG. 2 is a pictorial view of a top guide plate for controlling the movement of coins as contemplated by this invention.
FIG. 3 is a pictorial view of the rotating disc platform for coins illustrating in phantom lines the position of coin guides on the underside of the guide plate shown in FIG. 2.
FIG. 4 is a broken pictorial view illustrating an adjustable coin release as contemplated by this invention.

Referring to FIG. 1, a rotating disc 10 of approximately 8 to 20 inches in diameter is driven by motor 12, both being supported by a base 14. A top guide plate 16 is supported by a three-point mounting assembly, being pivotally mounted on base 14 by pivot mounts or supports 18 and 20 through mounting bar 22 and by latchable support 24. Thus, guide plate 16 may be opened back by unlatching latch support 24, whereby guide plate 16 would pivot about supports 18 and 20 and may be moved to a vertical position, exposing the top surface of disc 10. Disc 10 has a pliable or flexible surface 26 as may be provided by rubber pad 27 of approximately 0.1 to 0.6 inch in thickness. This pad, supported on plate 29 of disc 10, would typically have a resilience of 6 to 10 durometers. Coins 28 are supplied to the sorter through a hopper 30 which extends from opening 32 in guide plate 16. Hub 33 dispenses coins from the center of the disc.

Referring to FIGS. 2 and 3, it will be noted that the underside of guide plate 16, which is generally flat, has three downwardly extending guides, being peripheral limit guide 34, single file guide 36, and coin release or exit guide 38. Guides 34 and 36 function in conjunction with disc 10 to feed coins to release guide 38 as illustrated and as will be further explained below. Guide plate 16 is positioned with respect to rotating disc 10 such that these guides extend down to the top flexible surface 26 of disc 10, leaving the other regions 40 with a clearance in which coins are free to move unimpeded by the guides. Thus, the guide surfaces generally have a thickness of approximately 0.08 to 0.085 inch, corresponding generally to the thickest coin to be sorted. Guide 36 functions to route or feed coins from the central region 42 of disc 10 radially outward over a limited peripheral region of approximately 180 degrees where they would be stopped by an inner wall 44 of guide 38, and then as they are rotated, they would pass or are thereby fed through a single file passageway 46 to form a single file on peripheral limit guide 34, this guide having a tapered edge 48 which effects a wedge action on the coins, stabilizing their movement against radial bounce, causing the coins to be moved circumferentially in a spaced format as shown about disc 10. Coins reaching passageway 46 which are not against inner wall 44, and thus not in a single file, are captured by tapered edge 47 (similar to that shown in FIG. 10), pressed into pad 27, and rotated back into the center of disc 10. Double layers of coins are prevented in the passageways between guides by maintaining a clearance 0.08 to 0.085 inch) between the flexible surface of disc 10 and upper surface 49 of plate 16 of less than the double thickness of the thinnest coins to be sorted, in the present case dimes, which have a thickness of about 0.05 inch each. The coins continue, actually are moved or fed with their outer edge against guide 34 in the circular direction indicated by arrow 49 until they reach coin release guide 38. As shown, coin release guide 38 contains four coin release slots, coin release slot 50 for dimes, coin release slot 52 for pennies, coin release slot 54 for nickels, and coin release slot 56 for quarters. The slots comprise discrete or selected recessed areas in plate 16 and are of a width equal to or slightly larger than the diameter of such coins. As shown, the coins encounter progressively larger slots as they are rotated by disc 10 counterclockwise under coin release guide 38 by being compressed between the lower face 57 of guide 38 and the flexible surface of disc 10 and are released. Thus, the recessed areas forming the slots enable the releasing of coins at discrete circumferential positions.

Assume first that a dime is the first coin in line approaching coin release guide 38, it having its outer edge against the inner edge 60 of turned-in guide extension 61 of guide 34. The coin thus engages with its inner edge the outer leading edge 62 of guide 38, which edge is tapered upward to gradually depress a coin and seize it. Thus, from points 64 to 68, the coin is wedged in a stabilized radial position until it reaches the full dime width of dime slot 50 where it is freed of vertical restraint and is thus free to follow the outwardly extending path of slot 50 which extends essentially normal to a radial line and thus to the edge of disc 10, enabling a dime to be ejected at a peripheral position or path 70 at which a coin sorting bag or outer receptacle (not shown) would be positioned.

Assume next that a larger coin, say, a penny, arrives at and strikes leading edge 62 of guide 38. Such coin will be captured by the outwardly extending edge of guide 38 between points 64 and 68 and continue to be captured by virtue of the fact that the inner edge of the coin will be forced inward of the inner edge of dime slot 50 by edge 60, and thus be wedged between the top surface of disc 10 and guide 38. This will cause the coin to be moved in a rotary pattern rather than to be free to move outward. The rotary movement of the coin continues until it strikes penny slot 52, and since slot 52 is of a width to accommodate a penny, a penny will be released from vertical pressure, and, by virtue of its momentum, it will be hurled outward in slot 52 along a path 72 where it would be intercepted by a penny sorting bag or receptacle (not shown). In a similar manner, larger coins, nickels and quarters, would be captured and sorted by slots 54 and 56, respectively, being intercepted by bags at path positions 74 and 76, respectively.

FIG. 4 illustrates a coin release slot 78 formed by an adjustable guide member 80 which is movable in adjustment slots 82 to enable a coin release slot to be formed of any desired width. Such an adjustable slot assembly may be positioned as the first, intermediate, or last slot in a series, depending upon a desired range of adjustment. Similarly, it may be the only slot in an assembly where, for example, the sorter is to be employed as a coin verifier wherein it is only necessary that coins be routed in a single file from the device, enabling them to be hurled into space in a spaced single file where they can readily be counted by optical, electrical, or other conventional counting means.

Figures 5, 6, 7, 8, 9, 10:
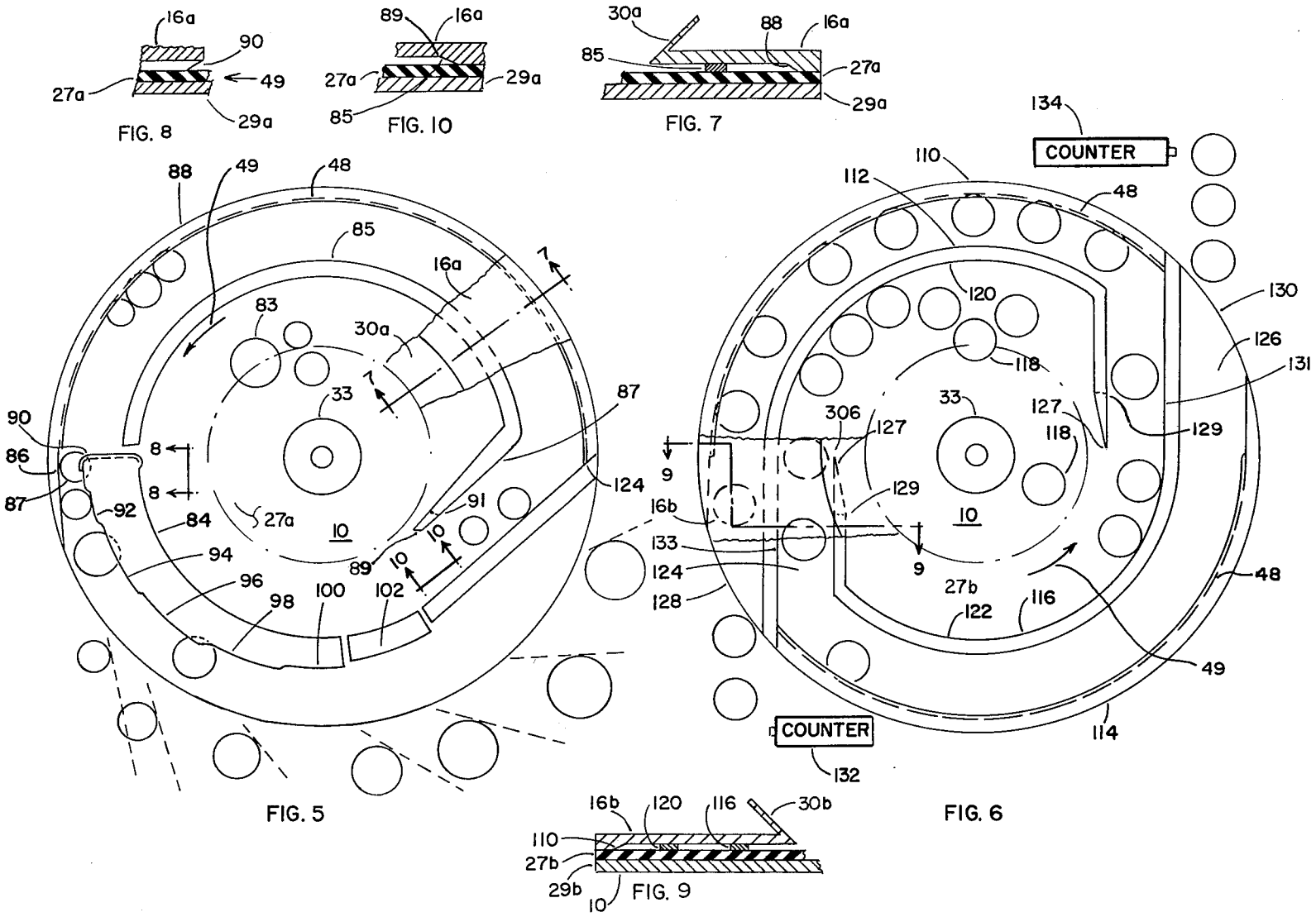
FIG. 5 is a plan view of a modification of this invention illustrated by a modified form of guide superimposed over a rotating disc.
FIG. 6 is a plan view of a further modification of this invention, particularly useful for coin count verifying illustrated by superimposing another form of guide assembly over a rotating disc.
FIG. 7 is a sectional view along lines 7—7 of FIG. 5.
FIG. 8 is a sectional view along lines 8—8 of FIG. 5.
FIG. 9 is a sectional view along lines 9—9 of FIG. 6.
FIG. 10 is a sectional view along lines 10—10 of FIG. 5.

FIG. 5 illustrates a further and simplified form of construction of the invention, showing the guide plates as they would be seen if viewing them vertically downward and without the flat supporting guide plate structure, except as briefly shown in broken form in section views thereof in FIGS. 7 and 8. Generally, circular guide 85, shown in FIG. 7, blocks the exit of coins from the center of disc 10 except through a single file passageway 87, leading edge 89 thereof being tapered, as shown in FIG. 10, to capture any coins tending to be stopped by the leading edge of guide 85, causing any such coins to be rotated back into the center of disc 10. The basic change illustrated by this embodiment of the invention is in the form of the coin release guide, illustrated by coin release guide 84. The leading edge 90 of this guide is illustrated in FIG. 8 as a part of top plate **16*a* (broken), illustrating that a coin carried in the direction 48*a* on pad 27*a* would be forced down into pad 27*a* and be captured and rotated in an arc having a discrete radius as defined by the captured coin. FIGS. 7 and 8 also illustrate that pad 27*a* is supported on circular plate 29*a*, typically secured in place by conical hub 33**.

In contrast to guide 38 shown in FIG. 3, guide 84 of FIG. 5 has only a series of progressively shortest radiused outer edges. Thus, for example, a dime 87 would be captured between outer guide 36, an extension of peripheral stop guide 80, and leading edge region 90 of guide 84 until that coin of coins 83 reaches the indentation 92, at which point a dime would be freed from restraint and would be hurled outward in the same manner as described above.

Coins larger than a dime would be initially secured in the same manner and would continue rotation in a circular pattern on disc 10 until released by one of the coin release indentations 94, 96, 98, 100, 102, or 104, each being of progressively shorter radius to progressively release larger coins as they travel counterclockwise. If desired, the device may be made to operate clockwise by reversing the arrangement of the guides. The actual number and outer edge radius of the releases are dependent upon the number and diameter of coins to be released. It is only necessary that the dimension between guide edge 90 and guide edge 86 be smaller than the smallest coin to be released in order to initially capture a coin. Coin release 102 is shown as being discrete from coin release guide 84 as an example of a removable or an interchangeable guide to accommodate a selected coin size greater than the size released by release edge 100. Coin release 104 also serves as an extension of guide 84 to prevent coins from escaping from the center of the coin sorter except by the release route described.

Guide 106 guides coins from the center of disc 10 onto the inner edge of guide 88 to form a single file as in the case of guide 36 of the embodiment shown in FIGS. 2 and 3.

FIG. 6 illustrates a coin verifier, a device which functions to arrange coins in a single file and then count them, the purpose being to determine the accuracy of a count of coins in some container. A device of the type illustrated in FIG. 6 would have the same drive system, rotating disc, top supporting plate, and hopper as shown in FIG. 1. This general arrangement is partially illustrated in the section view shown in FIG. 9 illustrating the relationship of hopper 30*b*, top plate 16*b*, and pad 26*b* on steel rotating plate 29*b* of disc 10. The guide configuration is different as shown in FIGS. 6 and 10. Except where broken for purposes of the section view, FIG. 6 shows only the downward extensions of plate 16*b* which form, in this case, peripheral limit guides 110 and 114, which are identical, and inner guides 112 and 116, also being identical. It would differ in that the guides which extend down from the top, flat, supporting guide plate 160 would be configured as shown in FIG. 6 wherein only the relief surface of the top supporting plate as shown in the form of guides 110, 112, 114, and 116 would be employed. Thus, as shown, coins 118 placed on disc 10 through hopper 30 (FIG. 1) would radiate outward against inner edges 120 and 122 of guides 110 and 116, and then would be routed through passageways 124 and 126 to form a single file which is edged against flexible pad 27*b* by guides 110 and 114, having a tapered configuration as shown in FIG. 9. This prevents bounce and increases speed of operation. Thus, coins would be rotated in a single file until they come to exits 128 and 130 where they would be hurled along a line outward to be intercepted or passed by counters 132 and 134, which would count them. Identical leading edges 127 of guides 112 and 116 are tapered back to point 129 similar to the tapering of guide 85 as shown in FIG. 10 so that any tendency of two coins wedged together between guides at the entrance to passageways 131 or 133 is prevented by the inner of such coins being captured under this tapered edge of the guide and the coin rotated back into the center region of the disc. A counter may be of a type employing light, radiation, magnetic, or another form of conventional sensing to effect counting. After leaving counters 130 and 132, coins would be fed to coin bags (not shown).

While the coin verifying device shown in FIG. 6 illustrates two verifying paths, a single one may be effected by making guides 110 and 114 continuous, omitting, for example, passageway 126 and making guides 116 and 112 circularly continuous and leaving a single exit 128.

It is to be noted that in contrast to previous verifiers, the present verifier needs no adjustment to verify different size coins. Further, by making the counters selective insofar as the denomination of coin counted is concerned, a monetary value count of coins passing through the verifier may be achieved or the detection of "off" denomination coins which were unintentionally mixed may be achieved.

Having thus described our invention, what is claimed is:

1. An apparatus for sorting coins of different denominations, said apparatus comprising:

a rotatable member having a resilient surface;

a stationary member having a surface that is substantially parallel to said resilient surface and positioned sufficiently close to said resilient surface so that at least portions of the stationary surface press any coins in contact therewith into the opposed resilient rotatable surface so that the resiliency of the rotatable surface urges the coins against the stationary surface with sufficient pressure to prevent radial movement of the coins by centrifugal force due to rotation of the rotatable member, while permitting circumferential movement of the coins by rotation of the rotatable member; and selected areas of the surface of said stationary member being recessed for releasing any coins entering such recessed areas from the pressure of said resilient surface and thereby permitting radial movement of coins within the recessed areas by centrifugal force due to rotation of the rotatable member, said recessed areas being shaped to (1) guide coins in single file along a predetermined path, and (2) permit coins of different sizes to escape radially from between said surfaces, by centrifugal force, at different preselected positions along the periphery of said stationary member.

2. A coin sorting apparatus comprising:

a pair of substantially parallel horizontal plates forming a pair of opposed surfaces which have at least portions thereof spaced slightly away from each other to permit coins to slide between the opposed surfaces;

one of said plates being stationary and the other plate being mounted for rotation about an axis that is substantially perpendicular to said opposed surfaces;

the rotatable plate having a resilient biasing surface for urging coins pressed therein toward the opposed surface of the stationary plate; and the stationary plate having a plurality of recessed areas therein for releasing any coins entering such recessed areas from the biasing pressure of said resilient surface and thereby permitting radial movement of coins between the two plates by rotation of the rotatable plate, said recessed areas being shaped to (1) guide coins in single file along an arcuate path between the plates, and (2) permit coins of different sizes to escape radially from between said plates at different predetermined positions around the periphery of the stationary plate.

3. A coin sorting apparatus as set forth in claim 2 which includes means for feeding coins between said rotatable and stationary members for sorting, said feeding means leading coins into one of said recessed areas in said stationary surface.

4. A coin sorting apparatus as set forth in claim 2 wherein said stationary surface includes a raised or non-recessed area between the recessed area that guides the coins in single file along said predetermined path and the recessed area that permits the smallest coins to escape radially from between said surfaces, said raised or non-recessed area pressing coins larger than said smallest coins into said resilient surface to prevent the escape of said larger coins at the predetermined position where the smallest coins are permitted to escape.

5. A coin sorting apparatus as set forth in claim 2 wherein said stationary surface includes a raised or non-recessed area between each pair of recessed areas that permit coins of different sizes to escape from between said surfaces, each such raises or non-recessed area pressing coins larger than the coins that are permitted to escape at each predetermined position into said resilient surface to prevent the escape of such larger coins until they reach another recessed area.

* * * * *